US005381936A

United States Patent [19]

Beery et al.

[11] Patent Number: 5,381,936

[45] Date of Patent: Jan. 17, 1995

[54] BACKPACK SUPPORT APPARATUS

[76] Inventors: Nicholas N. Beery, Box 314, Seeley Lake, Mont. 59868; David J. Piersak, 928 Lydia Rd., Helena, Mont. 59601

[21] Appl. No.: 110,014

[22] Filed: Aug. 23, 1993

[51] Int. Cl.[6] ..... A45F 4/02

[52] U.S. Cl. ..... 224/153; 224/210; 224/902; 248/188.5

[58] Field of Search ..... 224/151, 153–156, 224/158, 159, 210, 213, 235, 242, 249, 251, 902, 148, 212, 261, 262, 263; 362/388, 393, 402, 422, 424, 431, 103, 108, 157, 190, 253; 248/188.5, 96, 155.1; 211/195; 135/75, 107, 108, 114

[56] References Cited

U.S. PATENT DOCUMENTS

| | | | |
|---|---|---|---|
| 768,452 | 8/1904 | Hennessy | 135/65 |
| 3,868,177 | 2/1975 | Glass et al. | 350/301 |
| 3,879,084 | 4/1975 | Jones | 248/188.5 |
| 3,881,644 | 5/1975 | Demaline | 224/153 |
| 3,889,859 | 6/1975 | Joseph | 224/212 |
| 3,987,807 | 10/1976 | Varnell | 248/188.5 |
| 4,018,370 | 4/1977 | Wood | 224/263 |
| 4,045,040 | 8/1977 | Fails | 224/155 |
| 4,189,075 | 2/1980 | Hall | 224/261 |
| 4,408,260 | 10/1983 | Miedel | 362/190 |
| 4,684,129 | 8/1987 | Anderson et al. | 248/354.7 |
| 4,687,414 | 8/1987 | Wardy | 224/153 |
| 4,885,812 | 12/1989 | Lindner | 224/156 |
| 5,012,964 | 5/1991 | Falletta et al. | 224/153 |
| 5,277,349 | 1/1994 | Rowe | 224/154 |
| 5,284,280 | 2/1994 | Stonebraker et al. | 224/210 |
| 5,323,943 | 6/1994 | Elledge | 224/265 |

FOREIGN PATENT DOCUMENTS

| | | | |
|---|---|---|---|
| 1185937 | 4/1985 | Canada | 224/153 |

*Primary Examiner*—Henry J. Recla
*Assistant Examiner*—Gregory M. Vidovich

[57] ABSTRACT

A new and improved backpack support apparatus includes a first extensible leg assembly, a second extensible leg assembly, and a plurality of transverse strut assemblies connected between the first extensible leg assembly and the second extensible leg assembly. The transverse strut assemblies are capable of supporting a backpack and capable of resting on a wearer's back. A separable, extensible walking stick assembly is used and includes a top portion adapted to engage one of the transverse strut assemblies, such that the extensible walking stick assembly, the first extensible leg assembly, and the second extensible leg assembly form a three-legged support for the backpack. The first extensible leg assembly and the second extensible leg assembly include a plurality of telescopic leg members and lock assemblies for locking the telescopic leg members in extended orientations. The first extensible leg assembly and the second extensible leg assembly includes respective spring, assemblies which normally bias the respective telescopic leg members in a retracted position, and the lock assemblies are capable of locking the respective telescopic leg members in an extended position. The extensible walking stick assembly includes a plurality of telescopic stick members and lock assemblies for locking the telescopic stick members in extended orientations. Respective light assemblies may be supported by the first extensible leg assembly and/or the second extensible leg assembly. A transverse strut assembly may be adapted to receive and house a signaling device.

8 Claims, 5 Drawing Sheets

BACKPACK SUPPORT APPARATUS

BACKGROUND OF THE INVENTION

1. Field of the Invention

The present invention relates generally to backpacks, and, more particularly, to a device for facilitating removal of the backpack from the user's back and replacement of the backpack on the user's back.

2. Description of the Prior Art

Backpacking is a popular recreational activity. Backpacks are often loaded with a large number of items which occupy considerable space and which are quite heavy. This being the case, lifting the backpack from the ground to put the backpack on and lowering the backpack to the ground when the backpack is removed, can require a considerable expenditure of energy. This is especially so when large numbers of breaks are taken during a hike. In this respect, it would be desirable if a device were provided that reduces the need for lifting and lowering a backpack when putting the backpack on and taking it off.

When a backpack is taken off of a person and placed on the ground, the backpack often has a high center of gravity, is often unstable, and often tends to roll over. To prevent the backpack from rolling over, the backpack must be leaned against some object or must be placed on an even surface. In this respect, it would be desirable if a device were provided that prevents a backpack from rolling over when removed from the wearer.

When a person is hiking with a backpack, the person often seeks breaks in walking where the person can take some weight of the lead off of the person's legs and feet. Often the person seeks this relief without going to the trouble of removing the backpack. Such relief may be obtained by leaning against a vertically standing object such as a tree or wall. However, when hiking in open country, a wall, a tree, or other vertically standing object may not be available to lean against. In this respect, it would be desirable if a device were provided that enables a person wearing a backpack to be able to take some weight off of the legs and feet without leaning against a tree or a wall.

People often carry foodstuffs in their backpack. Because food-invading insects such as ants are often present on the ground, it would be desirable to be able to take the backpack off and set it down without subjecting it to invasion by ground insects.

When a hiker is hiking, the ground if often wet. In this respect, it would be desirable if a device were provided that precludes the need to place a backpack on a wet ground surface.

Throughout the years, a number of innovations have been developed relating to backpacks, and the following U.S. patents are representative of some of those innovations: 4,746,044; 4,938,400; 4,989,766; 5,004,135; and 5,016,792. More specifically, U.S. Pat. No. 4,746,044 discloses a backpack with a child carrier. U.S. Pat. No. 4,938,400 discloses a combination backpack and seat. U.S. Pat. No. 4,989,766 discloses a backpack that converts into a tree seat. U.S. Pat. No. 5,004,135 discloses an adjustable frame for a backpack. U.S. Pat. No. 5,016,792 discloses a backpack that converts into a seat. None of the patents cited above disclose a way to take some of the weight of the backpack off of the wearer's legs and feet without taking the backpack off of the back.

Still other features would be desirable in a backpack support apparatus. For example, hiking is often done at night, and lights may be used for night hiking. Common sources of lights are hand-held flashlights or lanterns. Yet carrying a flashlight or lantern in one's hand may be quite fatiguing over an extended period of time. Moreover, it may be desirable to have the hands free to perform a variety of other tasks. In this respect, it would be desirable if a device were provided that enables a hiker to provide light at night without carrying a flashlight or lantern in one's hand.

In some of the patents cited above, a frame for supporting a backpack is provided, and the frame includes hollow metal tubes. The hollow metal tubes serve essentially one function, that of supporting the backpack. Yet the hollow nature of the metal tubes forming the frame provide opportunities for storage that have been overlooked. For example, the hollow metal tubes could be used for storing electrical batteries to power battery-powered devices such as lights. In this respect, it would be desirable if a backpack frame device were provided that employs hollow metal tubes for storing electrical batteries.

Hikers often hike into wilderness areas where human assistance is not readily available in case of emergencies. In this respect, it would be desirable for a hiker to take along signaling devices to enable a searcher to find a stranded hiker. Rather than take up valuable backpack space with signaling devices, it would be desirable if hollow metal tubes of a frame could be used for carrying signaling devices.

Some hikers prefer to hike with the assistance of a walking stick. It would be desirable, however, if a walking stick could serve an additional function. In this respect, it would be desirable if a device were provided that provides an additional function for a walking stick.

Thus, while the foregoing body of prior art indicates it to be well known to use frames for backpacks, the prior art described above does not teach or suggest a backpack support apparatus which has the following combination of desirable features: (1) reduces the need for lifting and lowering a backpack when putting the backpack on and taking it off; (2) prevents a backpack from rolling over when removed from the wearer; (3) enables a person wearing a backpack to be able to take some weight off of the legs and feet without leaning against a tree or a wall; (4) enables a person to take the backpack off and set it down without subjecting it to invasion by ground insects; (5) precludes the need to place a backpack on a wet ground surface; (6) enables a hiker to provide light at night without carrying a flashlight or lantern in one's hand; (7) employs hollow metal tubes for storing electrical batteries; (8) employs hollow metal tubes of a frame for carrying signaling devices; and (9) provides an additional function for a walking stick besides merely assisting in walking. The foregoing desired characteristics are provided by the unique backpack support apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a new and improved backpack support apparatus which includes a first extensible leg assembly, a second extensible leg assembly, and a plurality of transverse strut assemblies connected between the first extensible leg assembly and the second extensible leg assembly. The transverse strut assemblies are capable of supporting a backpack and capable of resting on a wearer's back. A separable, extensible walking stick assembly is used and includes a top portion adapted to engage one of the transverse strut assemblies, such that the extensible walking stick assembly, the first extensible leg assembly, and the second extensible leg assembly form a three-legged support for the backpack. The first extensible leg assembly and the second extensible leg assembly include a plurality of telescopic leg members and lock assemblies for locking the telescopic leg members in extended orientations.

The first extensible leg assembly and the second extensible leg assembly includes respective spring assemblies which normally bias the respective telescopic leg members in a retracted position, and the lock assemblies are capable of locking the respective telescopic leg members in an extended position. The extensible walking stick assembly includes a plurality of telescopic stick members and lock assemblies for locking the telescopic stick members in extended orientations. The elastic cord, respective locking buttons in the lock assemblies, and respective apertures in the respective telescopic stick members operate in a way similar in operation to the operation of the similar components in the extensible leg assemblies.

A plurality of vertical strut members are connected between two transverse strut assemblies. The vertical strut members provide reinforcement and structural support for the apparatus.

Respective light assemblies may be supported by the first extensible leg assembly and/or the second extensible leg assembly. The respective light assemblies include a lamp, a holder for supporting the lamp and for connecting the lamp to the respective extensible leg assembly, and a plurality of batteries, housed within a transverse strut assemblies, for providing electrical energy to the lamp.

A transverse strut assembly may be adapted to receive and house a signaling device. The transverse strut assembly is connected between the first extensible leg assembly and the second extensible leg assembly. The transverse strut assembly includes a removable housing member for housing one or more signaling devices. A first transverse projection projects from the first extensible leg assembly toward the second extensible leg assembly, and a second transverse projection projects from the second extensible leg assembly toward the first extensible leg assembly, such that the removable housing member is capable of being placed between the first transverse projection and the second transverse projection and is connected therebetween.

The respective ends of the first transverse projection, the second transverse projection, and the removable housing member include threads, and the transverse strut assembly includes threaded ferrules which are capable of engaging respective ends of the removable housing member and a respective transverse projection for securing the removable housing member to the respective transverse projection.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least three preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved backpack support apparatus which has all of the advantages of the prior art and none of the disadvantages.

It is another object of the present invention to provide a new and improved backpack support apparatus which may be easily and efficiently manufactured and marketed.

It is a further object of the present invention to provide a new and improved backpack support apparatus which is of durable and reliable construction.

An even further object of the present invention is to provide a new and improved backpack support apparatus which is susceptible of a low cost of manufacture with regard to both materials and labor, and which accordingly is then susceptible of low prices of sale to the consuming public, thereby making such backpack support apparatus available to the buying public.

Still yet a further object of the present invention is to provide a new and improved backpack support apparatus which reduces the need for lifting and lowering a backpack when putting the backpack on and taking it off.

It is still another object of the present invention is to provide a new and improved backpack support apparatus that prevents a backpack from rolling over when removed from the wearer.

Yet another object of the present invention is to provide a new and improved backpack support apparatus which enables a person wearing a backpack to be able to take some weight off of the legs and feet without leaning against a tree or a wall.

Even another object of the present invention is to provide a new and improved backpack support apparatus that enables a person to take the backpack off and set it down without subjecting it to invasion by ground insects.

Still a further object of the present invention is to provide a new and improved backpack support apparatus which precludes the need to place a backpack on a wet ground surface.

Yet another object of the present invention is to provide a new and improved backpack support apparatus that enables a hiker to provide light at night without carrying a flashlight or lantern in one's hand.

Even yet another object of the present invention is to provide a new and improved backpack support apparatus which employs hollow metal tubes for storing electrical batteries.

Yet another object of the present invention is to provide a new and improved backpack support apparatus that employs hollow metal tubes of a frame for carrying signaling devices.

Still a further object of the present invention is to provide a new and improved backpack support apparatus that provides an additional function for a walking stick besides merely assisting in walking.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

Figure 1:
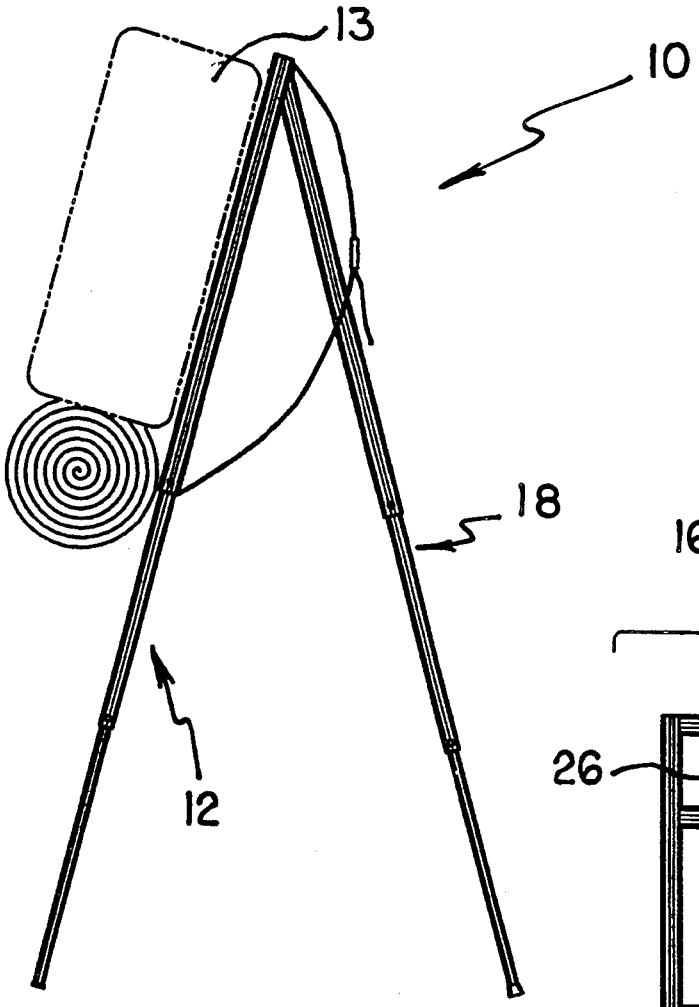
FIG. 1 is a side view showing a first preferred embodiment of the backpack support apparatus of the invention in a free standing orientation with a backpack in place on the apparatus.
Figure 2:
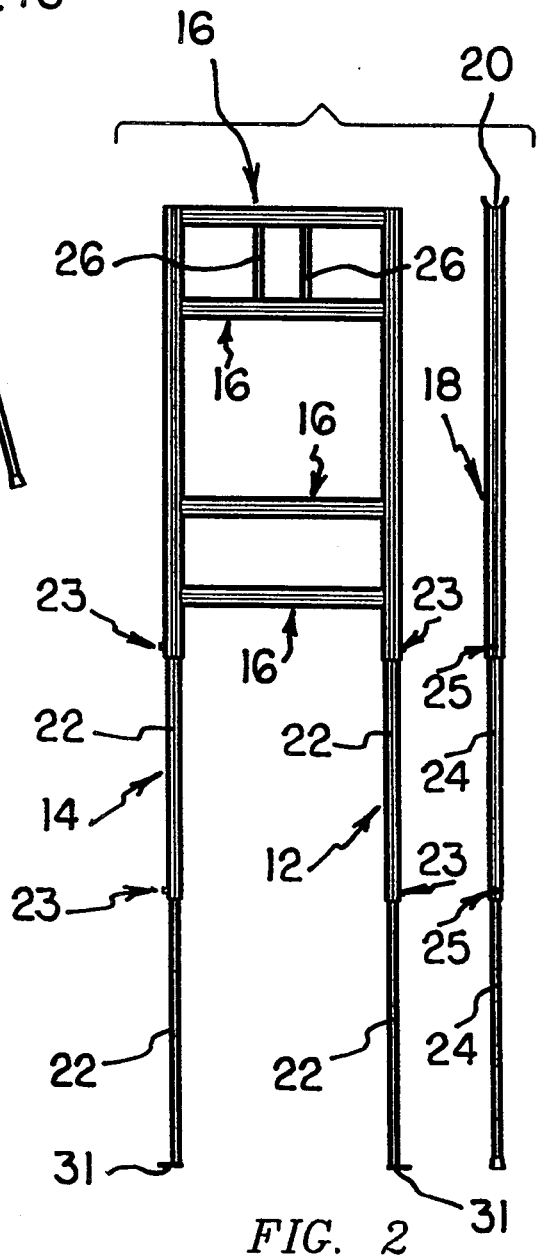
FIG. 2 is an exploded frontal view of the embodiment of the invention shown in FIG. 1 with the backpack removed.

With reference to the drawings, a new and improved backpack support apparatus embodying the principles and concepts of the present invention will be described.

Turning initially to FIGS. 1–4, there is shown a first exemplary embodiment of the backpack support apparatus of the invention generally designated by reference numeral 10. In its preferred form, backpack support apparatus 10 includes a first extensible leg assembly 12, a second extensible leg assembly 14, and a plurality of transverse strut assemblies 16 connected between the first extensible leg assembly 12 and the second extensible leg assembly 14. The transverse strut assemblies 16 are capable of supporting a backpack 13 and capable of resting on a wearer's back. A separable, extensible walking stick assembly 18 is used and includes a top portion 20 adapted to engage one of the transverse strut assemblies 16, such that the extensible walking stick assembly 18, the first extensible leg assembly 12, and the second extensible leg assembly 14 form a three-legged support for the backpack 13. The top portion 20 of the extensible walking stick assembly 18 is concave in cross-sectional shape so as to engage a complementary convex shaped transverse strut assembly 16. The first extensible leg assembly 12 and the second extensible leg assembly 14 include a plurality of telescopic leg members 22 and lock assemblies 23 for locking the telescopic leg members 22 in extended orientations.

Figure 3:
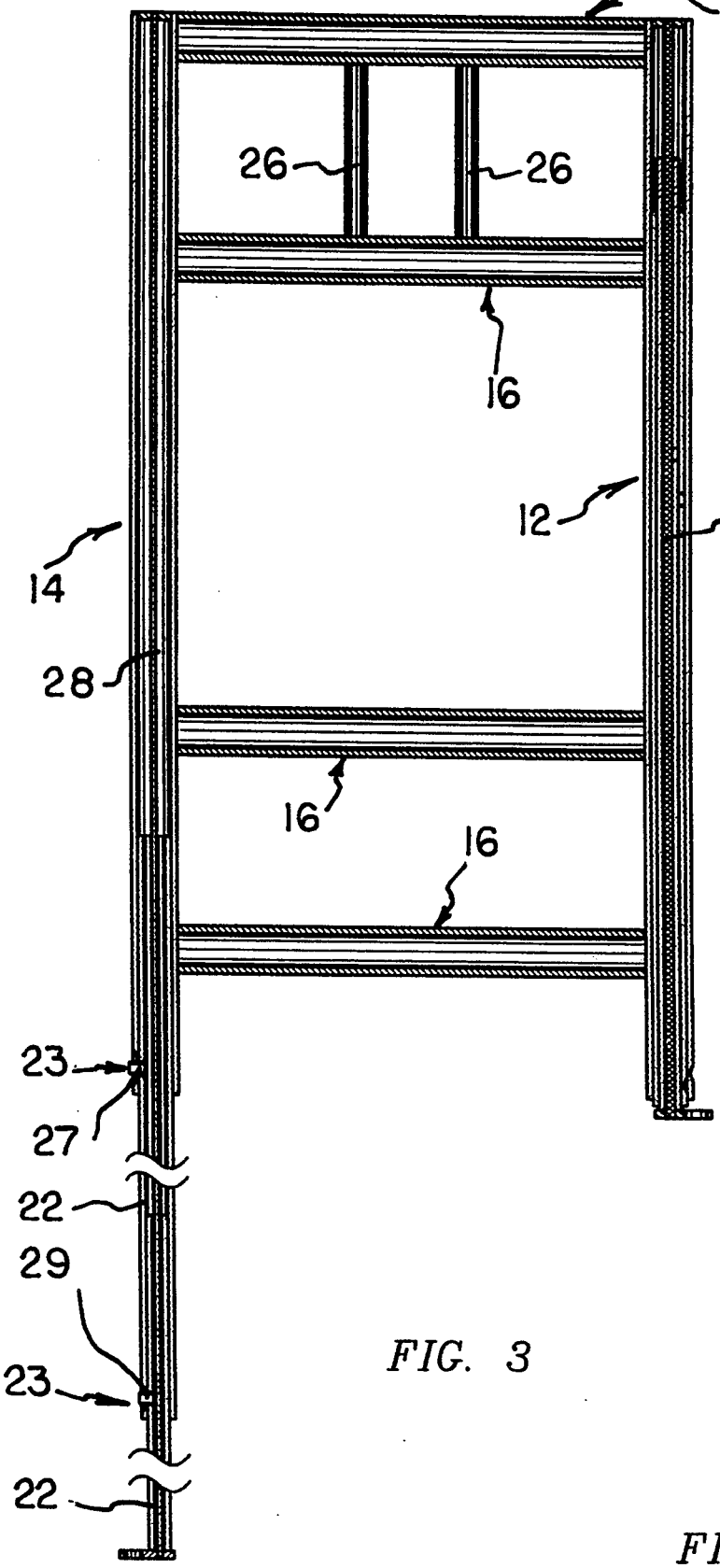
FIG. 3 is an enlarged cross-sectional view of the back-retained portion of the backpack support apparatus of FIG. 2.
Figure 4:
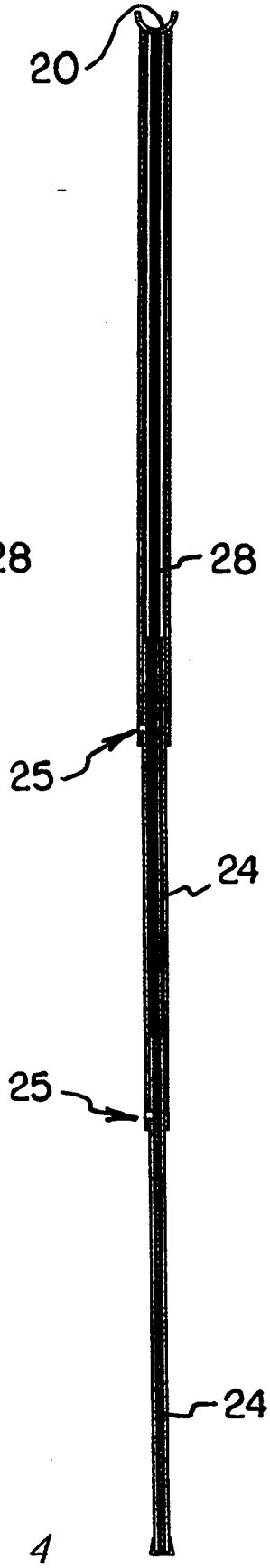
FIG. 4 is an enlarged cross-sectional view of the walking stick portion of the backpack support apparatus of FIG. 2.

More specifically, as shown with the second extensible leg assembly 14 in FIG. 3, a locking button 27 is in registration with an aperture in the first telescopic leg member 22. In addition, another locking button 29 is in registration with another aperture in the second telescopic leg member 22. To place the telescopic leg members 22 in the extended positions, the elastic cord 28 must be stretched by pulling the telescopic leg members 22 out from a nested orientation to an extended orientation.

When the respective locking buttons 27 and 29 are pulled out of the respective apertures in the respective telescopic leg members 22, the telescopic leg members 22 can be retracted telescopically by the elastic cord 28. The first extensible leg assembly 12 and the second extensible leg assembly 14 include respective spring assemblies 28 which normally bias the respective telescopic leg members 22 in a retracted position, and the lock assemblies 23 are capable of locking the respective telescopic leg members 22 in an extended position. The telescopic leg members 22 are shown in their retracted position for first extensible leg assembly 12 in FIG. 3. In contrast, the telescopic leg members 22 are shown in their extended position for the second extensible leg assembly 14 in FIG. 3. The lock assemblies 23 lock the telescopic leg members 22 into the extended position.

The spring assemblies 28 are in the form of elastic cords 28. In the second extensible leg assembly 14 in FIG. 3, the elastic cord 28 is in a stretched condition. In the first extensible leg assembly 12 in FIG. 3, the elastic cord 28 is in a relaxed and retracted condition. The extensible walking stick assembly 18 includes a plurality of telescopic stick members 24 and lock assemblies 25 for locking the telescopic stick members 24 in extended orientations. The elastic cord 28, respective locking buttons in the lock assemblies 25, and respective apertures in the respective telescopic stick members 24 operate in a way similar in operation to the operation of the similar components in the extensible leg assemblies.

A plurality of vertical strut members 26 are connected between two transverse strut assemblies 16. The vertical strut members 26 provide reinforcement and structural support for the apparatus 10. Each of the first and the second extensible leg assemblies is capable of extending a sufficient distance such that the respective lower ends of the first and the second extensible leg assemblies are capable of contacting a ground portion and partially supporting a backpack when a backpack wearer is in a standing position.

Figure 5:
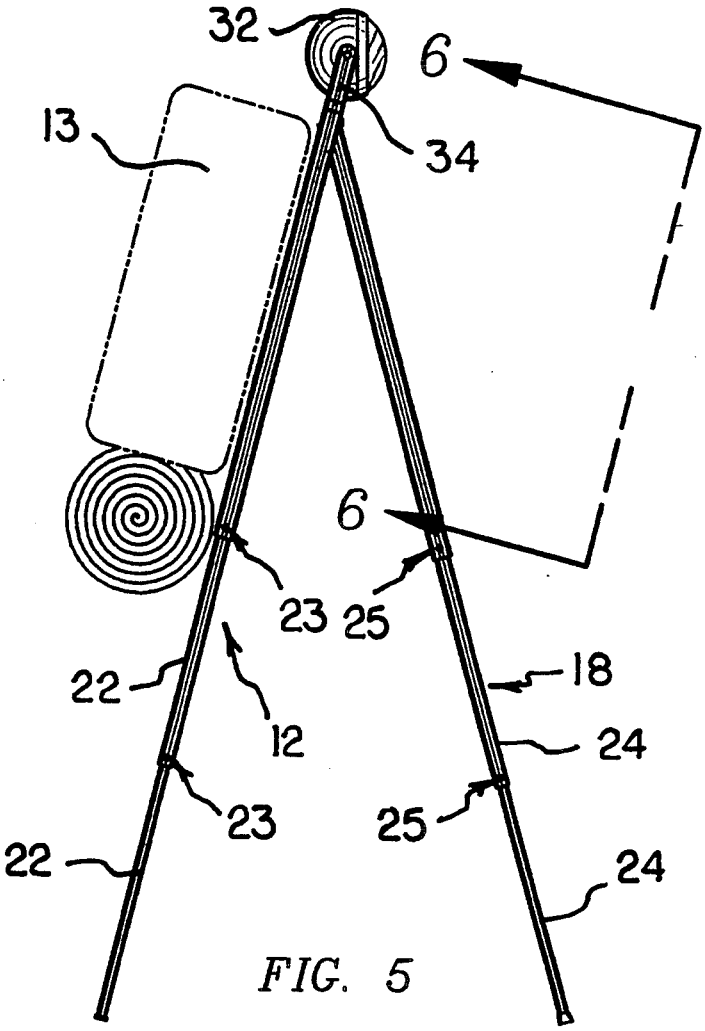
FIG. 5 is a side view showing a second embodiment of the backpack support apparatus of the invention in a free standing orientation with a backpack in place on the apparatus and with lights on the apparatus.
Figure 6:
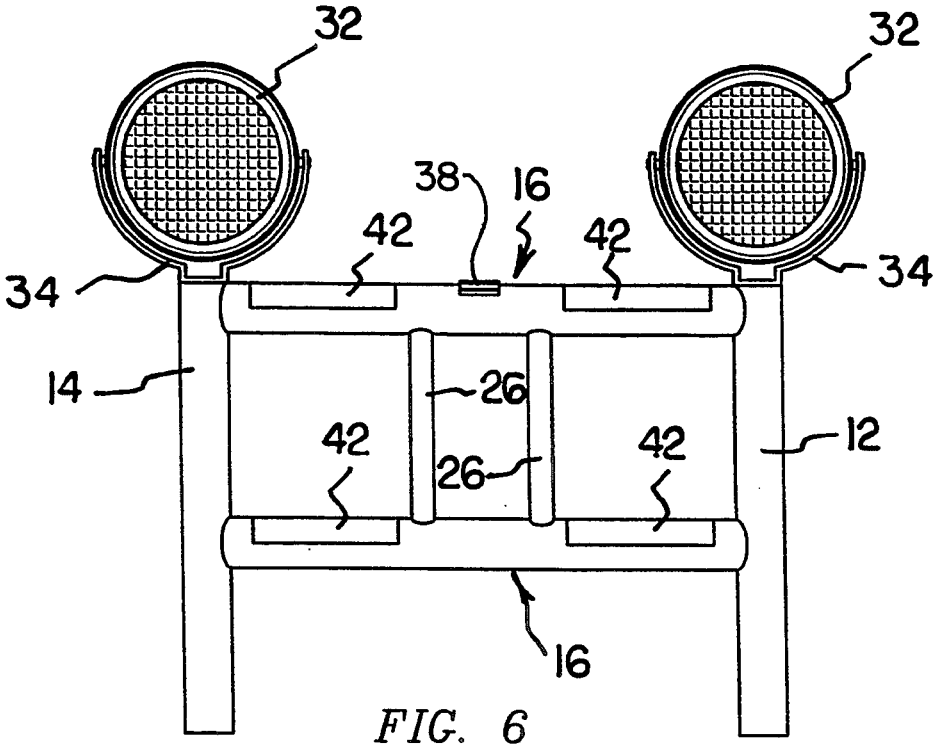
FIG. 6 is an enlarged, partial front view of the lights in the embodiment shown in FIG. 5.
Figure 7:
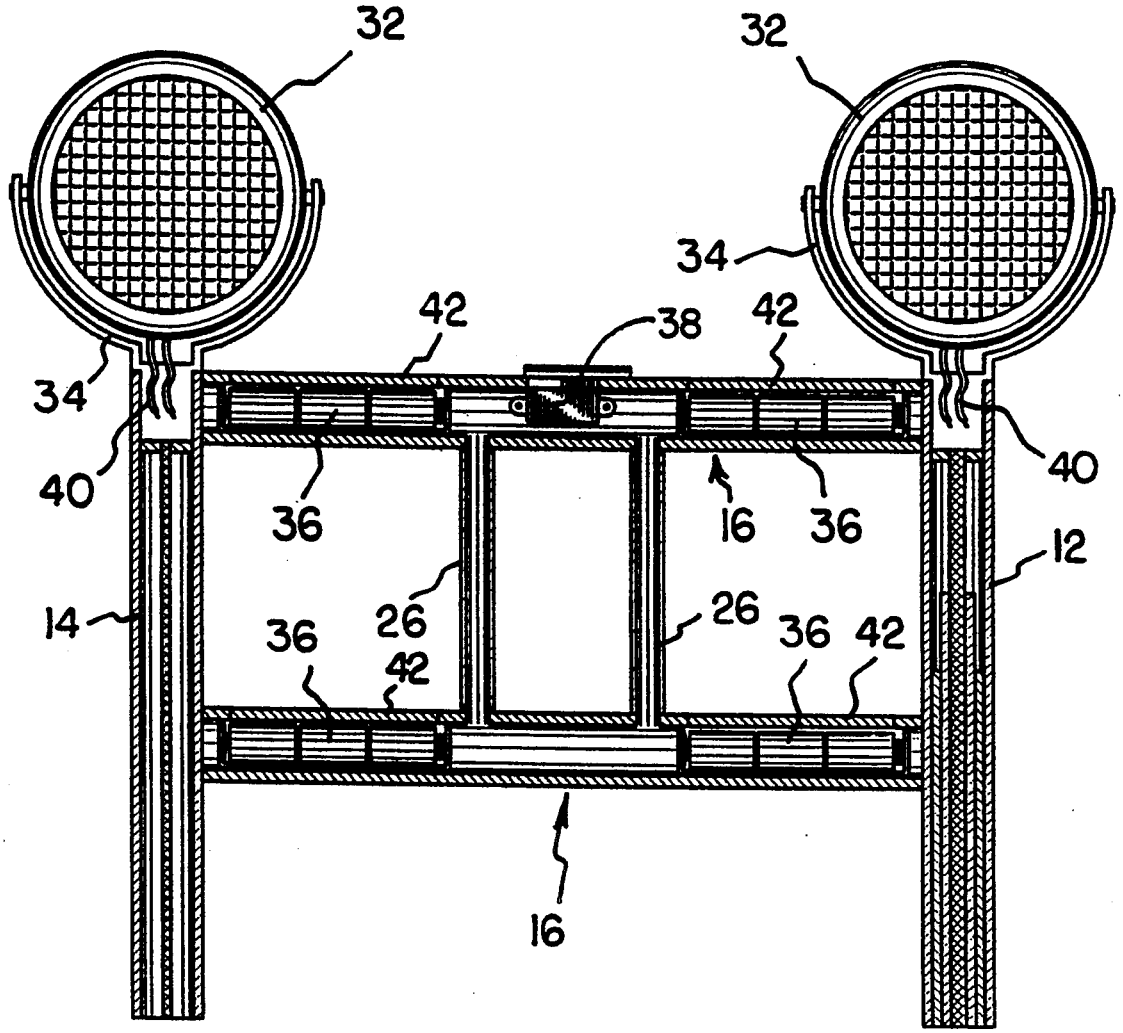
FIG. 7 is an enlarged, cross-sectional view of the embodiment shown in FIG. 6.

Turning to FIGS. 5–7, a second embodiment of the invention is shown. Reference numerals are shown that correspond to like reference numerals that designate like elements shown in the other figures. In addition, respective light assemblies are supported by the first extensible leg assembly 12 and/or the second extensible leg assembly 14. The respective light assemblies include a lamp 32, a holder 34 for supporting the lamp 32 and for connecting the lamp 32 to the respective extensible leg assembly, and a plurality of batteries 36, housed within a transverse strut assemblies 16, for providing electrical energy to the lamp 32. A switch 38 is used to selectively light the lamp 32. Wires 40 are used to connect the lamp 32 to the switch 38 and the batteries 36. The batteries 36 are retained in a transverse strut assembly 16, and a cover 42 is provided for gaining access to the batteries 36.

Figure 8:
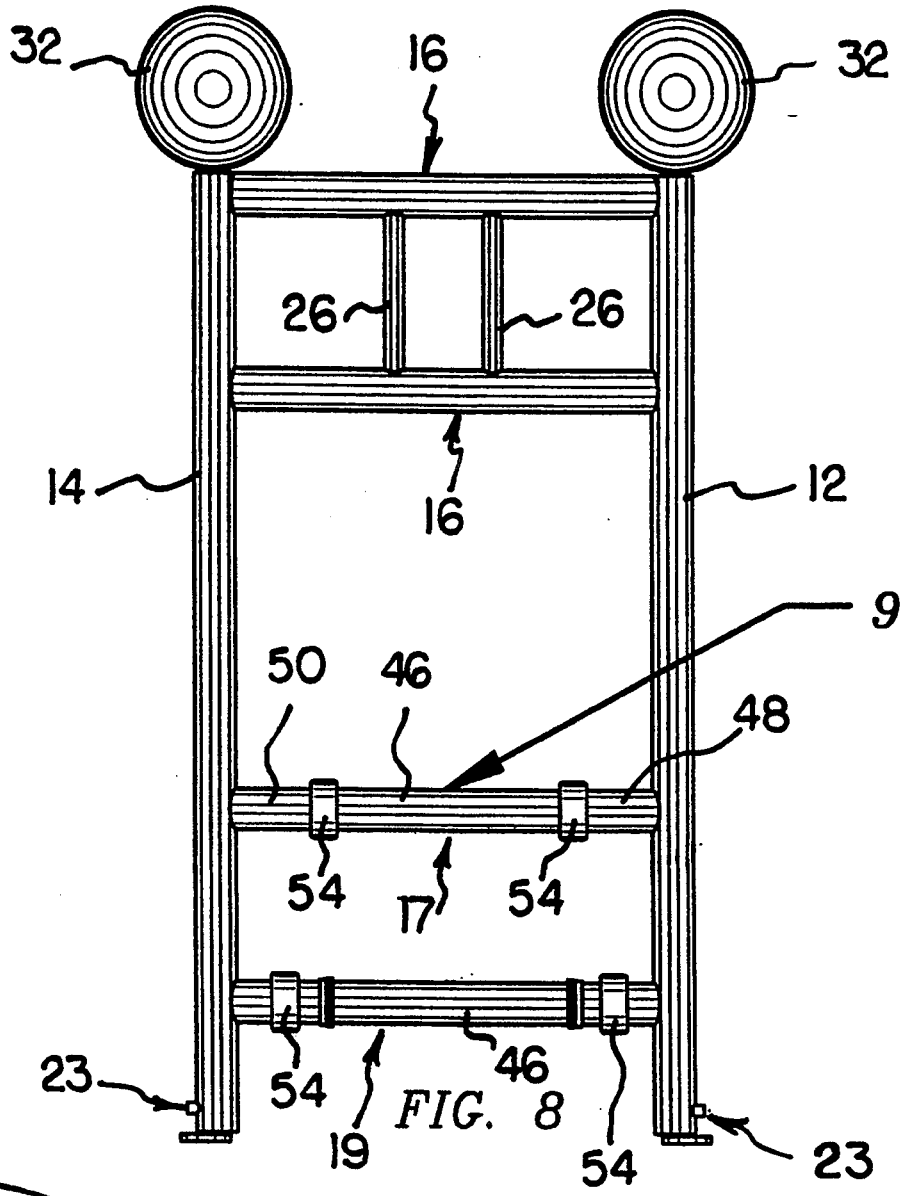
FIG. 8 is a front view of a third embodiment of the invention which includes a number of stored signaling flares.
Figure 9:
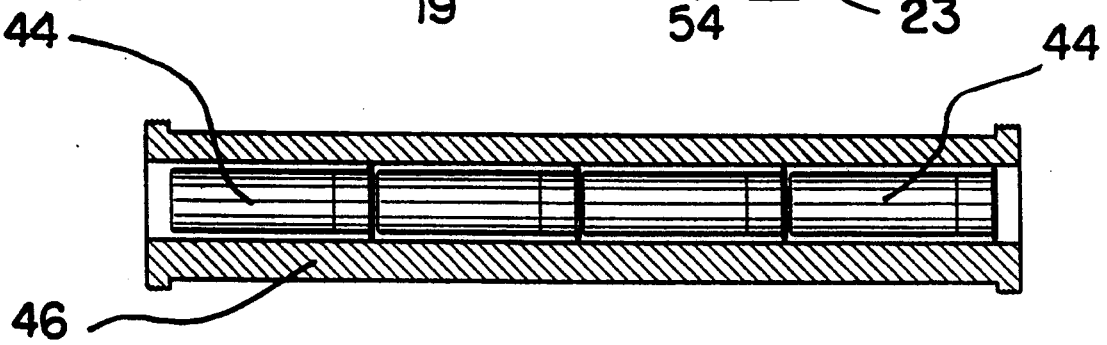
FIG. 9 is an enlarged cross-sectional view of the flare storage tube pointed out in FIG. 8.

Turning to FIGS. 8–9, a third embodiment of the invention is shown. Reference numerals are shown that correspond to like reference numerals that designate like elements shown in the other figures. In addition, a transverse strut assembly 17 is adapted to receive and house a signaling device 44. The transverse strut assembly 17 is connected between the first extensible leg assembly 12 and the second extensible leg assembly 14. The signaling device 44 is shown in FIG. 9 to be a flare cartridge 44.

The transverse strut assembly 17 includes a removable housing member 46 for housing one or more signaling devices 44. A first transverse projection 48 projects from the first extensible leg assembly 12 toward the second extensible leg assembly 14, and a second transverse projection 50 projects from the second extensible leg assembly 14 toward the first extensible leg assembly 12, such that the removable housing member 46 is capable of being placed between the first transverse projection 48 and the second transverse projection 50 and is connected therebetween. The respective ends of the first transverse projection 48, the second transverse projection 50, and the removable housing member 46 include threads, and the transverse strut assembly 17 includes threaded ferrules 54 which are capable of engaging respective ends of the removable housing member 46 and a respective transverse projection for securing the removable housing member 46 to the respective transverse projection.

The transverse strut assembly 17 in FIG. 8 shows the ferrules 54 in engagement with the removable housing member 46 and respective ends of the first transverse projection 48 and the second transverse projection 50. In contrast, another transverse strut assembly 19 shows the ferrules 54 out of engagement with the removable housing member 46 and the respective ends of the first transverse projection 48 and the second transverse projection 50.

As shown in FIGS. 1 and 5, the first extensible leg assembly 12, the second extensible leg assembly 14, and the extensible walking stick assembly 18 work in conjunction to form a three-legged, free-standing, above ground support for the backpack 13. In this mode of operation, the backpack 13 has been removed from the wearer. Alternatively, the backpack 13 can be retained on the wearer, and the wearer can extend the telescopic leg members 22 of the first extensible leg assembly 12 and the second extensible leg assembly 14 to allow the wearer to lean against the feet 31 without taking the backpack 13 off of the back of the wearer. In this way, the wearer can take some of the weight of the backpack 13 off of the wearer's feet and legs without removing the backpack 13 from the back and without lowering the backpack 13 to the ground level.

The components of the backpack support apparatus of the invention can be made from inexpensive, durable, and lightweight aluminum tubing elements. Alternatively, plastic tubing can also be used.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved backpack support apparatus that is low in cost, relatively simple in design and operation, and which may advantageously be used to reduce the need for lifting and lowering a backpack when putting the backpack on and taking it off. With the invention, a backpack support apparatus is provided which prevents a backpack from rolling over when removed from the wearer. With the invention, a backpack support apparatus is provided which enables a person wearing a backpack to be able to take some weight off of the legs and feet without leaning against a tree or a wall. With the invention, a backpack support apparatus is provided which enables a person to take the backpack off and set it down without subjecting it to invasion by ground insects. With the invention, a backpack support apparatus is provided which precludes the need to place a backpack on a wet ground surface. With the invention, a backpack support apparatus is provided which enables a hiker to provide light at night without carrying a flashlight or lantern in one's hand. With the invention, a backpack support apparatus is provided which employs hollow metal tubes for storing electrical batteries. With the invention, a backpack support apparatus is provided which employs hollow metal tubes of a frame for carrying signaling devices. With the invention, a backpack support apparatus is provided which provides an additional function for a walking stick besides merely assisting in walking.

With respect to the above description, it should be realized that the optimum dimensional relationships for the parts of the invention, to include variations in size, form function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by Letters Patent of the United States is as follows:

1. A new and improved backpack support apparatus, comprising:

a first extensible leg assembly, a second extensible leg assembly, and a plurality of transverse strut assemblies connected between said first extensible leg assembly and said second extensible leg assembly, said transverse strut assemblies capable of supporting a backpack and capable of resting on a wearer's back, wherein each of said first and said second extensible leg assemblies is capable of extending a sufficient distance such that respective lower ends of said first and said second extensible leg assemblies are capable of partially supporting said backpack and contacting a ground portion at the same level as a surrounding ground portion supporting a wearer of said backpack when said wearer is in a vertically, upright standing position.

2. The apparatus described in claim 1 wherein said first extensible leg assembly and said second extensible leg assembly each include a plurality of telescopic leg members and lock assemblies for locking said telescopic leg members in extended orientations.

3. The apparatus described in claim 1, further including:

a separable, extensible walking stick assembly which includes a concave top portion adapted to receive one of said transverse strut assemblies, such that said extensible walking stick assembly, said first extensible leg assembly, and said second extensible leg assembly form a three-legged support for the backpack.

4. The apparatus described in claim 3 wherein said extensible walking stick assembly includes a plurality of telescopic stick members and lock assemblies for locking said telescopic stick members in extended orientations.

5. The apparatus described in claim 1, further including:

a plurality of vertical strut members connected between two transverse strut assemblies, said vertical strut members providing reinforcement for said apparatus.

6. A new and improved backpack support apparatus, comprising:

a first extensible leg assembly, a second extensible leg assembly, and a plurality of transverse strut assemblies connected between said first extensible leg assembly and said second extensible leg assembly, said transverse strut assemblies capable of supporting a backpack and capable of resting on a wearer's back, wherein each of said first and said second extensible leg assemblies is capable of extending a sufficient distance such that respective lower ends of said first and said second extensible leg assemblies are capable of partially supporting said backpack and contacting a ground portion at the same level as a surrounding ground portion supporting a wearer of said backpack when said wearer is in a vertically, upright standing position, wherein said first extensible leg assembly and said second extensible leg assembly each include a plurality of telescopic leg members and lock assemblies for locking said telescopic leg members in extended orientations, wherein said first extensible leg assembly and said second extensible leg assembly each include respective spring assemblies which normally bias said respective telescopic leg members in a retracted position, and wherein said lock assemblies are capable of locking said respective telescopic leg members in an extended position.

7. The apparatus described in claim 6, further including:

a separable, extensible walking stick assembly which includes a concave top portion adapted to receive one of said transverse strut assemblies, such that said extensible walking stick assembly, said first extensible leg assembly, and said second extensible leg assembly form a three-legged support for the backpack.

8. The apparatus described in claim 7 wherein said extensible walking stick assembly includes a plurality of telescopic stick members and lock assemblies for locking said telescopic stick members in extended orientations.

* * * * *